US007841596B2

(12) United States Patent
Okumura et al.

(10) Patent No.: US 7,841,596 B2
(45) Date of Patent: Nov. 30, 2010

(54) SHEET FEEDER

(75) Inventors: Yoshinobu Okumura, Yamatokoriyama (JP); Yasushi Matsutomo, Nara (JP); Haruo Sayama, Yamatokoriyama (JP); Yasunobu Ohkawa, Nara (JP); Michihiro Yamashita, Nara (JP); Yuriko Kamei, Nara (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/863,414

(22) Filed: Sep. 28, 2007

(65) Prior Publication Data

US 2008/0258380 A1 Oct. 23, 2008

(30) Foreign Application Priority Data

Oct. 2, 2006 (JP) ..... 2006-270978

(51) Int. Cl.
*B65H 5/34* (2006.01)
*B65H 7/02* (2006.01)

(52) U.S. Cl. ..... 271/270; 271/265.02

(58) Field of Classification Search ..... 271/265.02, 271/270, 202, 264, 265.01
See application file for complete search history.

(56) References Cited

U.S. PATENT DOCUMENTS 4,804,998 A * 2/1989 Miyawaki ..... 399/21
5,219,157 A * 6/1993 Takahashi ..... 271/114
5,295,677 A * 3/1994 Hutner ..... 271/110
5,485,247 A * 1/1996 Morishita et al. ..... 399/16
5,540,426 A * 7/1996 Nakamura et al. ..... 271/265.01
6,259,886 B1 7/2001 Ishii et al.

(Continued)

FOREIGN PATENT DOCUMENTS

JP 63112330 * 5/1988

(Continued)

OTHER PUBLICATIONS

Chinese Office Action for corresponding application No. CN 200710163081.7 dated Jul. 10, 2009.

*Primary Examiner*—Stefanos Karmis
*Assistant Examiner*—Patrick Cicchino
(74) *Attorney, Agent, or Firm*—Renner, Otto, Boisselle & Sklar, LLP

(57) ABSTRACT

A sheet feeder has a feed passage and includes feed roller pairs, sensors, and a controller. The feed roller pairs are arranged along the feed passage and feed sheets of paper in a feed direction along the passage by nipping the sheets. Each of the sensors is fitted at or near one of the feed roller pairs and senses a specified point on each of the sheets when the sheet is nipped by at least the associated roller pair. The controller includes a memory for storing reference feed timings as proper feed timings at each of which the specified points on the sheets should pass one of the sensors. The controller finds the real feed timing when each of the sensors senses the specified point on the sheet nipped by at least the associated roller pair. When each of the sensors senses the specified point on the sheet nipped by at least the associated roller pair, the controller finds the time difference between the associated reference feed timing and the associated real feed timing and controls, according to the found time difference, the feed speed at which the feed roller pair or pairs nipping the sheet feed it.

6 Claims, 5 Drawing Sheets

U.S. PATENT DOCUMENTS

| | | | | |
|---|---|---|---|---|
| 6,381,441 | B1 * | 4/2002 | Byeon et al. | 399/396 |
| 6,402,133 | B1 * | 6/2002 | Miyake | 271/3.19 |
| 6,641,134 | B1 * | 11/2003 | Dobbertin et al. | 271/226 |
| 6,651,980 | B2 * | 11/2003 | Isemura et al. | 271/259 |
| 6,883,800 | B2 * | 4/2005 | Mizuno | 271/270 |
| 7,068,969 | B2 * | 6/2006 | Ueda | 399/388 |
| 7,275,740 | B2 * | 10/2007 | Able et al. | 271/10.01 |
| 7,293,769 | B2 * | 11/2007 | Asari et al. | 271/258.01 |
| 7,308,853 | B2 * | 12/2007 | Satoh et al. | 101/118 |
| 7,548,721 | B2 * | 6/2009 | Isozaki | 399/388 |
| 7,651,090 | B2 * | 1/2010 | Satoh et al. | 271/265.02 |
| 2002/0079637 | A1 * | 6/2002 | Skadow et al. | 271/10.01 |
| 2003/0057639 | A1 * | 3/2003 | Chapman et al. | 271/270 |
| 2004/0217538 | A1 * | 11/2004 | Kawamura | 271/9.01 |
| 2004/0251589 | A1 * | 12/2004 | Satoh et al. | 271/10.01 |
| 2006/0202407 | A1 | 9/2006 | Yasui et al. | |
| 2008/0203655 | A1 * | 8/2008 | Bruhn et al. | 271/265.01 |
| 2008/0237979 | A1 * | 10/2008 | Tamura et al. | 271/270 |

FOREIGN PATENT DOCUMENTS

| | | |
|---|---|---|
| JP | 63315439 | * 12/1988 |
| JP | 04-168076 | 6/1992 |
| JP | 05-016461 | 1/1993 |
| JP | 09-175693 | 7/1997 |
| JP | 11-249525 | 9/1999 |
| JP | 11249525 | * 9/1999 |
| JP | 2006-137579 | 6/2006 |

* cited by examiner

SHEET FEEDER

CROSS REFERENCE

This Nonprovisional application claims priority under 35 U.S.C. §119(a) on Patent Application No. 2006-270978 filed in Japan on Oct. 2, 2006, the entire contents of which are hereby incorporated by reference.

BACKGROUND OF THE INVENTION

The present invention relates to a sheet feeder for feeding sheets of paper by means of feed roller pairs along a feed passage.

An image forming apparatus or another apparatus that provides processing for sheets of paper includes a feed unit, a sheet feeder, and a processing unit for forming an image on a sheet of paper. The sheet feeder has a feed passage leading from the feed unit to the processing unit. The sheet feeder includes a registration roller pair supported at the end of the feed passage.

Before the leading end of a sheet of paper reaches the registration roller pair, the rotation of the roller pair pauses. While the rotation is pausing, an angular adjustment is carried out to correct the angular position of the sheet with respect to the feed direction in which the sheet is being fed. Subsequently, the registration roller pair rotates to feed the sheet to the processing unit at such a timing that the leading end of the sheet registers with the leading end of an image formed in the processing unit. It is essential that the sheet feeder should feed sheets of paper with a space left between each sheet and the following sheet so as to allow time for carrying out an angular adjustment for each sheet at the registration roller pair.

In recent years, the processing speed of image forming apparatus has been increasing. In order for an image forming apparatus to print 40-60 sheets of paper per minute, its sheet feeder can feed sheets of paper with a space of 50-100 mm between each sheet and the following sheet. However, in order for the apparatus to print 100 or more sheets of paper per minute, the sheet feeder can feed sheets of paper with a space of only less than 50 mm between each sheet and the following sheet. In this case, it is difficult to allow time for carrying out angular adjustments at the registration roller pair of the apparatus.

The sheet feeder also includes a pickup roller and a parting roller. If the pickup roller picks up two or more sheets of paper at a time from the feed unit, the parting roller feeds one of them at a time, with the other sheet or sheets remaining at the parting roller. When the parting roller feeds the remaining sheet or one of the remaining sheets, the sheet starts to be fed from a position downstream from the feed unit of the apparatus. This results in advanced feed timing. If the pickup roller rotates at high speed, it may slip on a sheet of paper when picking up the sheet. This results in delayed feed timing.

The sheet feeder feeds sheets of paper at a preset speed along the feed passage. Advanced feed timing shortens the intervals between the sheets. The short intervals may make it impossible to allow time for carrying out angular adjustments at the registration roller pair. The short intervals may position the leading end of each sheet over or under the trailing end of the preceding sheet. Delayed feed timing widens the intervals between the sheets, thereby reducing the printing rate of the apparatus.

JP-H4-168076A discloses a conventional sheet feeder. In the acceleration range where this sheet feeder raises the feed speed at which it feeds sheets of paper, it raises the speed to a target speed while changing the acceleration state.

However, because the conventional sheet feeder changes the acceleration state under preset conditions, it is impossible for this feeder to change the acceleration state according to variable intervals between sheets of paper. This makes it impossible for the conventional sheet feeder to restrain the instability in the positions and directions in which it feeds sheets of paper, such as oblique feeding to a processing unit, paper jams, and feed speed drops.

SUMMARY OF THE INVENTION

The object of the present invention is to provide a sheet feeder that can restrain the instability in the positions and directions in which it feeds sheets of paper to a processing unit, paper jams, and feed speed drops.

A sheet feeder according to the present invention has a feed passage and includes feed roller pairs, sensors, and a controller. The feed roller pairs are arranged along the feed passage and feed sheets of paper in a feed direction along the passage by nipping the sheets. Each of the sensors is fitted at or near one of the feed roller pairs and senses a specified point on each of the sheets when the sheet is nipped by at least the associated roller pair. The controller includes a memory for storing reference feed timings as proper feed timings at each of which the specified points on the sheets should pass one of the sensors. The controller finds the real feed timing when each of the sensors senses the specified point on the sheet nipped by at least the associated roller pair. When each of the sensors senses the specified point on the sheet nipped by at least the associated roller pair, the controller finds the time difference between the associated reference feed timing and the associated real feed timing and controls, according to the found time difference, the feed speed at which the feed roller pair or pairs nipping the sheet feed it.

DETAILED DESCRIPTION OF THE INVENTION

Figure 1:
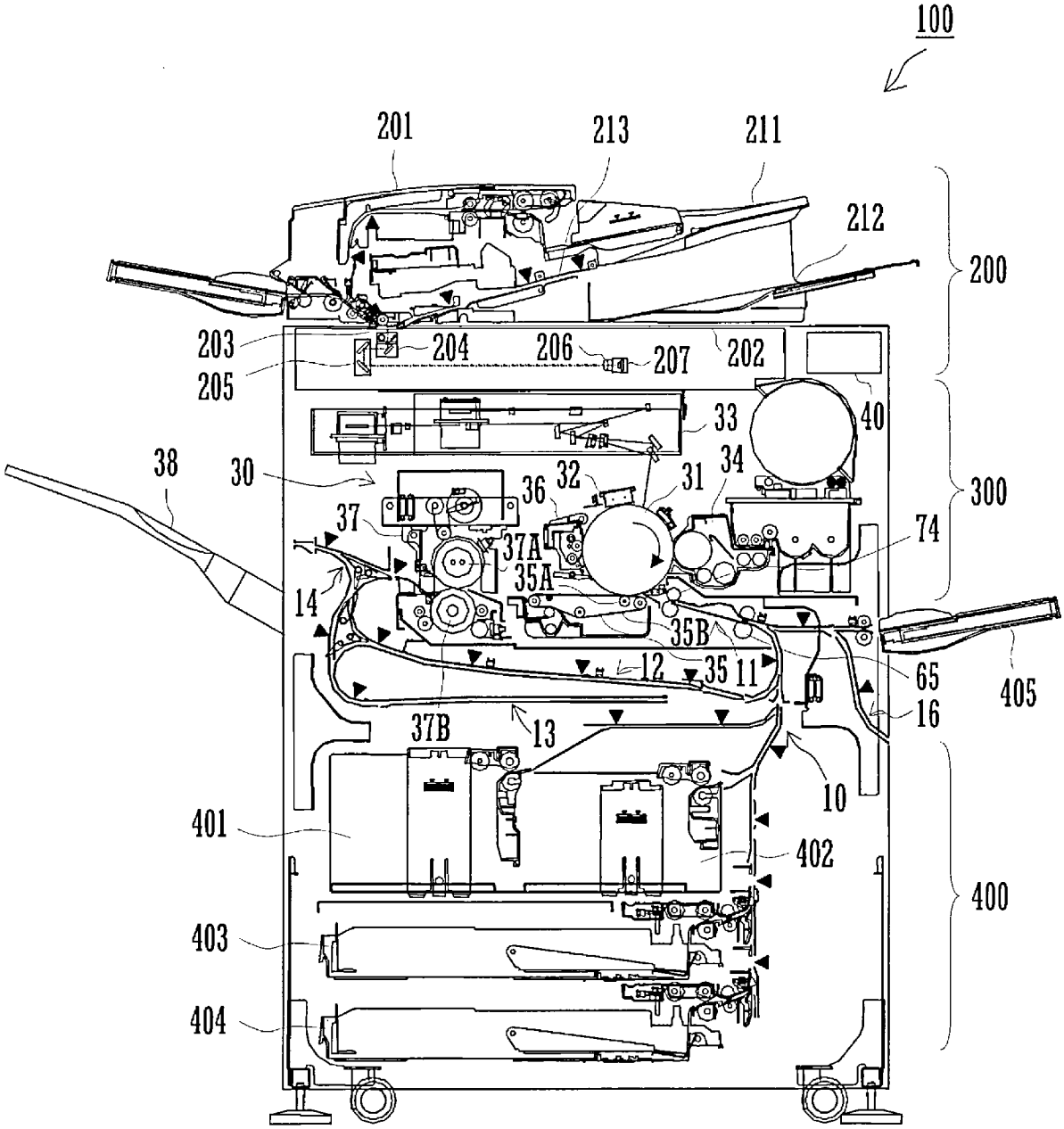
FIG. 1 is a sectional front view of an image forming apparatus to which a sheet feeder embodying the present invention is applied.

The best mode of carrying out the present invention will be described below with reference to the accompanying drawings. FIG. 1 shows an image forming apparatus 100 to which a sheet feeder 50 (FIG. 2) embodying the present invention is applied. The apparatus 100 includes a controller 40, an image reading unit 200, an image recording unit 300, and a feed unit 400.

The image reading unit 200 includes an automatic document feeder 201, a first document platform 202, a second document platform 203, a first mirror base 204, a second mirror base 205, a lens 206, and a charge coupled device (CCD) 207.

The document feeder 201 has a feed passage 213, which leads from a document tray 211 via the second document platform 203 to an outlet tray 212. The document feeder 201 feeds documents one after one into the feed passage 213. The rear edge of the document feeder 201 is so supported that this feeder can pivotably cover the upper side of the first document platform 202. By raising the front edge of the document feeder 201 so as to expose the upper side of the first document platform 202, it is possible to place a document manually on this platform.

The document platforms 202 and 203 are a hard glass plate.

The mirror bases 204 and 205 can move horizontally under the document platforms 202 and 203. The speed at which the second mirror base 205 moves is ½ of the speed at which the first mirror base 204 moves. The first mirror base 204 carries a light source and a first mirror. The second mirror base 205 carries a second mirror and a third mirror.

The image on a document being fed by the document feeder 201 is read with the first mirror base 204 stopping under the second document platform 203. The light source on the first mirror base 204 under the second document platform 203 radiates light to the front side of the document passing over this platform. The light reflected by this side of the document is then reflected by the first mirror on the first mirror base 204 toward the second mirror base 205.

The image on a document placed on the first document platform 202 is read with the mirror bases 204 and 205 moving horizontally under this platform. The light source on the first mirror base 204 moving under the first document platform 202 radiates light to the front side of the document on this platform. The light reflected by this side of the document is then reflected by the first mirror on the first mirror base 204 toward the second mirror base 205.

Whether the document feeder 201 is used or not, the light reflected by the front side of the document is incident on the CCD 207 via the lens 206 by means of the second and third mirrors on the second mirror base 205, with the optical path length kept constant.

The CCD 207 outputs an electric signal based on the quantity of light reflected by the front side of the document. The electric signal is input as image data (information) into the image forming unit 300.

The image recording unit 300 includes an image former 30, which consists of a photosensitive drum 31, a charging unit 32, an exposure unit 33, a developing unit 34, a transfer unit 35, a cleaning unit 36, and a fixing unit 37.

The photosensitive drum 31 has a photosensitive layer formed on its cylindrical surface and rotates clockwise in FIG. 1. The charging unit 32 charges the drum surface uniformly to a preset electric potential. The charging unit 32 may be either a non-contact type charging unit with a charger or a contact type charging unit with a roller or a brush.

The exposure unit 33 irradiates the cylindrical surface of the photosensitive drum 31 with light based on the image data. Photoconduction in the photosensitive layer of the drum 31 forms an electrostatic latent image on the irradiated surface of the drum 31. The exposure unit 33 scans the drum surface axially of the drum 31 by means of a polygon mirror with a laser beam modulated with the image data. Alternatively, the exposure unit 33 might be replaced by an exposure unit having an array of ELs, LEDs, or other light emitting devices.

The developing unit 34 supplies the cylindrical surface of the photosensitive drum 31 with toner so as to convert the electrostatic latent image into a toner image, which is visible.

The transfer unit 35 includes a transfer roller 35A and a transfer belt 35B. The transfer belt 35B forms a loop around rollers under the photosensitive drum 31 and has an electric resistance between about $1\times10^{9}$ and $1\times10^{13}\Omega\cdot$cm. The transfer roller 35A is supported inside the transfer belt 35 and biased to bring it into compressive contact with the cylindrical surface of the photosensitive drum 31. A transfer voltage is applied to the transfer roller 35A. The toner image carried by the drum 31 is transferred to a sheet passing between the drum and the transfer belt 35.

The cleaning unit 36 removes the toner remaining on the portion of the drum surface from which the toner image has been transferred to the sheet.

The fixing unit 37 includes a heating roller 37A and a pressing roller 37B. The heating roller 37A has a heater fitted in it for heating it to a temperature at which the toner on this roller can melt. The pressing roller 37B is biased into compressive contact with the heating roller 37A under a preset pressure. While the sheet with the toner image on it is passing between these rollers 37A and 37B, the fixing unit 37 heats and presses the sheet so as to fix the image fast on the sheet. After passing through the fixing unit 37, the sheet is conveyed to an outlet tray 38, which is fitted on the right (left in FIG. 1) side of the image forming apparatus 100.

The feed unit 400 includes feed cassettes 401-404 and a manual feed tray 405. Each of the feed cassettes 401-404 holds sheets of paper of a size. The manual feed tray 405 supports a sheet of paper of size or quality for less frequent use.

The feed unit 400 feeds sheets of paper one after one from one of the feed cassettes 401-404 or the manual feed tray 405. A sheet fed from the feed unit 400 is then fed to the image former 30 through feed passages 10 and 11 by feed roller pairs 61-65 (FIG. 2).

Figure 2:
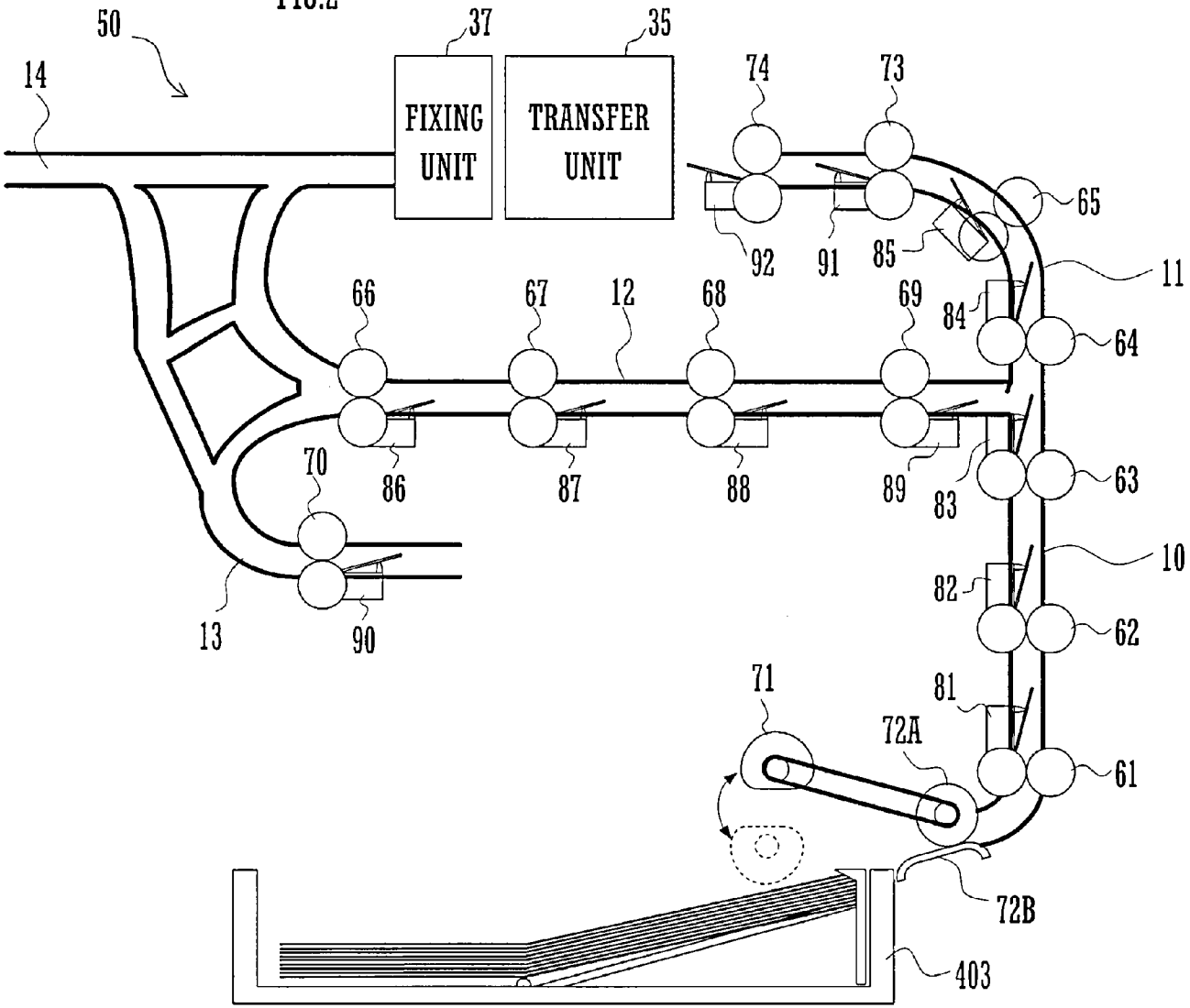
FIG. 2 is a schematic sectional front view of the sheet feeder.

With reference to FIG. 2, a before-registration roller pair 73 and a registration roller pair 74 are supported on the feed passage 11 downstream from the feed roller pairs 61-65. The rotation axes of the registration roller pair 74 are perpendicular to the feed direction in which it feeds a sheet of paper. The feed roller pairs 61-65 feed a sheet of paper to the before-registration roller pair 73. With the registration roller pair 74 pausing, the before-registration roller pair 73 thrusts the leading end of the fed sheet against the nip of the registration roller pair 74. If the sheet deviates angularly from the feed direction, the sheet end thrusting corrects the deviation. Thus, while the registration roller pair 74 is not rotating, an angular adjustment is carried out to correct angular deviation of a sheet of paper.

The registration roller pair 74 starts rotating to feed the sheet to the position between the photosensitive drum 31 and the transfer belt 35B at such a timing that the leading end of the sheet registers with the leading end of a toner image formed on the drum 31. After the toner image is transferred and fixed to the sheet in the ways described already, the sheet is delivered to the outlet tray 38.

A large capacity cassette (LCC) for holding a large number of sheets of paper can be positioned under the manual feed tray 405 on the left (right in FIG. 1) side of the image forming apparatus 100. A sheet from the large capacity cassette is fed to the image former 30 through a feed passage 16.

The sheet feeder 50 will be described below with reference to FIG. 2 as for feeding sheets of paper from the feed cassette 403 only, but the feeder feeds sheets of paper likewise from the feed cassettes 401, 402 and 404.

The sheet feeder 50 has feed passages 10-14 and includes feed roller pairs 61-70, a pickup roller 71, a parting roller 72A, a parting member 72B, before-registration roller pair 73, registration roller pair 74, and sensors 81-92.

The feed passages 10 and 11 are main feed passages. The main feed passage 10 leads from the feed cassette 403 to the main feed passage 11, which leads from the passage 10 to the transfer unit 35.

The feed passage 12 is a reversing feed passage, which leads from the downstream side of the fixing unit 37 to the upstream end of the main feed passage 11. The feed passage 13 is a switchback feed passage, one end of which communicates with a middle portion of the reversing feed passage 12.

By way of example, after a sheet delivered from the fixing unit 37, with an image formed on one side of the sheet, is conveyed to the switchback feed passage 13, the sheet is conveyed in the opposite direction from this passage to the reversing feed passage 12, from which the sheet is subsequently conveyed to the main feed passage 11 so as to be fed upside down to the transfer unit 35. This forms an image on the other side of the sheet as well. The transfer unit 35 and fixing unit 37 correspond to the processing unit of the present invention.

The feed passage 14 leads from the downstream side of the fixing unit 37 to the outlet tray 38.

The pickup roller 71, parting roller 72A, and parting member 72B are positioned at the upstream end of the main feed passage 10. The pickup roller 71 can shift around the parting roller 72A. The parting roller 72A is biased into compressive contact with the parting member 72B under a preset pressure. If the pickup roller 71 picks up two or more sheets of paper, the parting roller 72A feeds only the top one of them. By way of example, the axes of the pickup roller 71 and parting roller 72A are spaced at a suitable distance of 30-50 mm from each other.

The feed roller pairs 61-63 and sensors 81-83 are arranged along the main feed passage 10 downstream from the parting roller 72A. The sensors 81-83 sense a sheet of paper near the downstream sides of the feed roller pairs 61-63 respectively.

The feed roller pairs 64 and 65, before-registration roller pair 73, and registration roller pair 74 are arranged along the main feed passage 11 in order from the upstream end of this passage. The sensors 84, 85, 91, and 92 are arranged along the main feed passage 11 and sense a sheet of paper near the downstream sides of these roller pairs 64, 65, 73, and 74 respectively.

The feed roller pairs 66-69 and sensors 86-89 are arranged along the reversing feed passage 12. The feed roller pairs 66-69 sense a sheet of paper near the downstream sides of these roller pairs 66-69 respectively.

The sensors 81-90 at the feed roller pairs 61-70 correspond to the sensors of the present invention. Regardless of the sensing results output from the sensor 91 for the before-registration roller pair 73, the controller 40 reduces the feed speed at which this roller pair feeds a sheet of paper. Regardless of the sensing results output from the sensor 92 for the registration roller pair 74, this pair feeds a sheet of paper at a feed speed V. Therefore, these sensors 91 and 92 do not correspond to the sensors of the present invention.

The feed roller pair 70 and sensor 90 are positioned on the switchback feed passage 13. The sensor 90 senses a sheet of paper near the downstream side of this roller pair 70.

Figure 3:
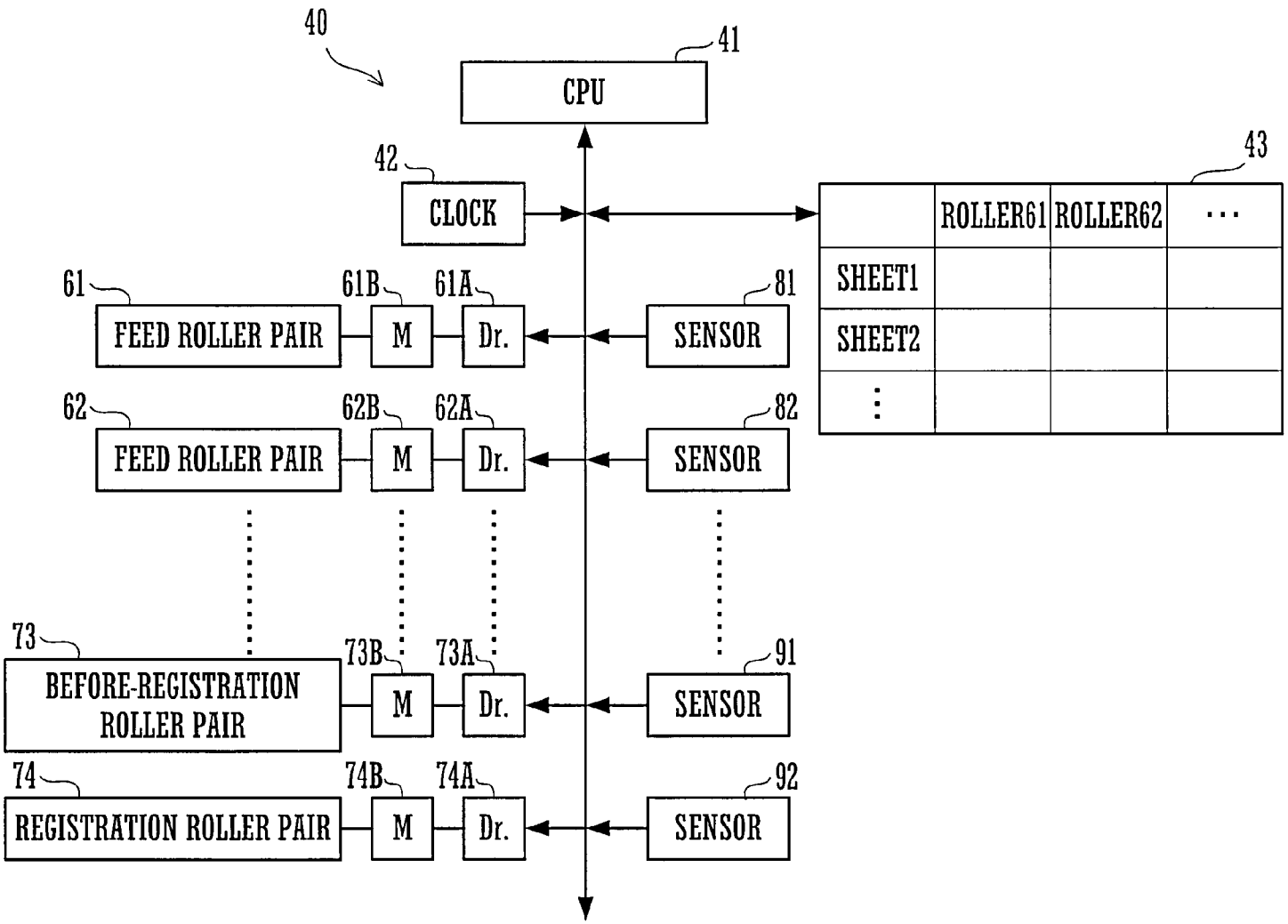
FIG. 3 is a block diagram of the sheet feeder.

FIG. 3 schematically shows the configuration of the sheet feeder 50.

The controller 40 includes a CPU 41, a clock 42, a memory 43, and drivers 61A-74A. The drivers 61A-74A are connected to motors 61B-74B respectively, which rotate the roller pairs 61-70, 73 and 74 respectively.

All sensors 81-92 sense the leading end of a sheet of paper by being turned on and also sense the trailing end of the sheet by being turned off. The sensors 81-92 output the sensing results to the CPU 41.

By way of example, when one of the sensors 81-90 at the feed roller pairs 61-70 senses the leading end of a sheet of paper, the CPU 41 identifies, as the feed roller pairs nipping the sheet, the feed roller pairs associated with this sensor and the sensor or sensors positioned upstream from it in series and tuned on.

Based on the sensing results output from the sensors 81-92, the CPU 41 makes the drivers 61A-74A so drive the motors 61B-74B as to adjust the rotation, pausing, rotational speed, and other conditions of the roller pairs 61-70, 73 and 74.

The clock 42 outputs time information to the CPU 41. The memory 43 stores first and second reference feed timings, which are the proper feed timings when the leading or trailing ends of sheets of paper should pass the sensors 81-90 at the feed roller pairs 61-70. The reference feed timings may be such that the sheet feeder 50 feeds sheets of paper at suitable time intervals so that time can be allowed for carrying out an angular adjustment for each sheet at the registration roller pair 74. In other words, the reference feed timings are such that the leading end of each sheet cannot be positioned over or under the trailing end of the preceding sheet at the registration roller pair 74.

Each of the first reference feed timings is the length between the time when the pickup roller 71 starts to feed a sheet of paper and the time when one of the sensors 81-85 along the main feed passages 10 and 11 should sense the leading end of the sheet for the first time if the sheet is fed normally to the associated feed roller pair.

The memory 43 includes a number of storage areas, each of which stores information on the time or times when one of the sheets being fed in series passes one of the sensors 81-90 for the feed roller pairs 61-70.

The controller 40 finds first and second real feed timings. Each of the first real feed timings is the length between the time when the pickup roller 71 starts to feed a sheet of paper and the time when one of the sensors 81-85 along the main feed passages 10 and 11 senses the leading end of the sheet for the first time. The controller 40 finds the time difference between the first real feed timing and first reference feed timing for each of the sensors 81-85. Based on the found time difference, the controller 40 changes the feed speed at which the feed roller pair or pairs nipping the sheet feed it.

Each of the second reference feed timings is the length between the time when the feed roller pair 70 on the switchback feed passage 13 reverses the direction in which a sheet of paper is being fed and the time when one of the sensors 86-89 along the reversing feed passage 12 and the sensors 84 and 85 along the main feed passage 11 should sense the leading end of the sheet after the reversal of direction if the sheet is fed normally to the associated feed roller pair. Each of the second real feed timings is the length between the time when the feed roller pair 70 reverses the direction in which a sheet of paper is being fed and the time when one of these sensors 84-89 senses the leading end of the sheet. The controller 40 finds the time difference between the second real feed timing and second reference feed timing for each of the sensors 84-89. Based on the found time difference, the controller 40 changes the feed speed at which the feed roller pair or pairs nipping the sheet feed it.

Figure 4:
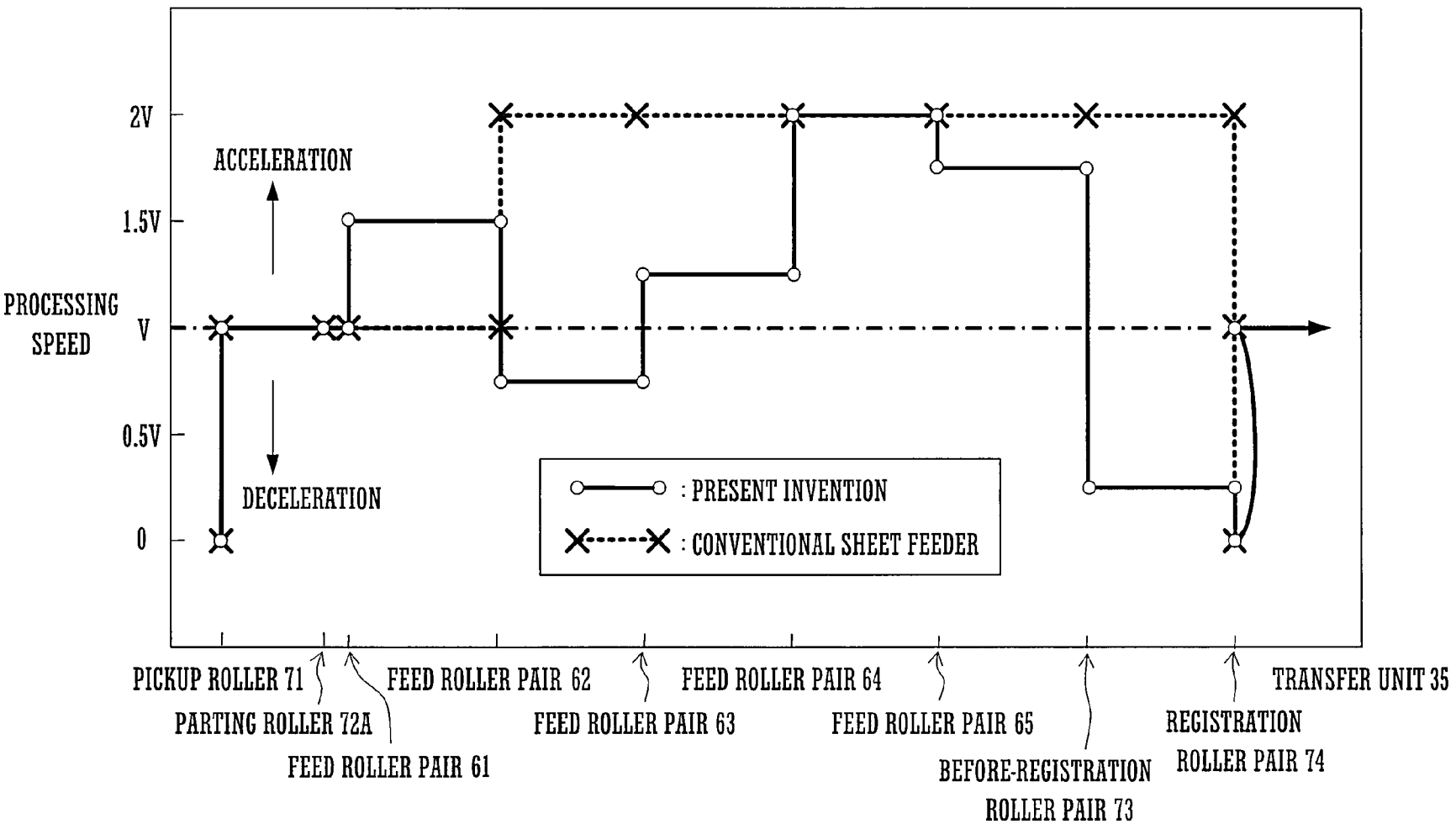
FIG. 4 is a diagram of speeds at which the sheet feeder feeds sheets of paper at various positions along feed passages in the feeder.

In FIG. 4, the solid lines represent feed speeds at which the sheet feeder 50 feeds sheets of paper at various positions along the main feed passages 10 and 11. In FIG. 4, the broken lines represent feed speeds at which a conventional sheet feeder for comparison feeds sheets of paper at various positions along the main feed passages in it.

In the present invention, the pickup roller 71 and parting roller 72A feed sheets of paper at the processing speed of V at which the transfer unit 35 and fixing unit 37 move the sheets. In the conventional feeder, also, the pickup roller (71) and parting roller (72A) feed sheets of paper at the processing speed of V, at which the transfer unit (35) and fixing unit (37) move the sheets.

In the conventional feeder, even the feed roller pair (61) feeds a sheet of paper at the processing speed of V, and the sheet is fed from the feed roller pair (62) to the registration roller pair (74) at the speed of 2V, which is twice the speed of V. After the leading end of the sheet is thrust against the registration roller pair (74), the sheet is halted at this roller pair, and an angular adjustment is carried out for the sheet. Subsequently, the registration roller pair (74) feeds the sheet at the speed of V to the transfer unit (35) of this feeder.

When the pickup roller 71 picks up a sheet of paper from the feed cassette 403, this roller may slip on the sheet. This may result in delayed feed timing. If the pickup roller 71 picks up two or more sheets of paper at a time, the parting roller 72A feeds one of them at a time, with the other sheet or sheets remaining at the parting roller. When the parting roller 72A feeds the remaining sheet or one of the remaining sheets, the sheet starts to be fed from a position downstream from the feed cassette 403. This may result in advanced feed timing.

The conventional feeder feeds sheets of paper at preset speeds at various positions in it. Accordingly, even if a sheet of paper is fed at an advanced or delayed timing in this feeder, it is impossible to adjust the interval between this sheet and each of the preceding sheet and following sheet. Advanced feed timing shortens sheet intervals. The short intervals may make it impossible to allow time for carrying out angular adjustments at the registration roller pair 74. The short intervals may position the leading end of each sheet over or under the trailing end of the preceding sheet. Delayed feed timing widens sheet intervals, thereby lowering the printing rate.

In the conventional feeder, a sheet of paper is thrust against the registration roller pair (74) at the speed of 2V, which is twice the processing speed of V. As a reaction, the leading end of the sheet may be turned back. This may make the sheet form an angle with the feed direction, or may position the leading end of the sheet off the nip of the registration roller pair (74).

In the present invention, the controller 40 finds a real feed timing based on the sensing result output from each of the sensors 81-90 at the feed roller pairs 61-70, finds the time difference between the found timing and the associated reference feed timing, and changes according to the found time difference the feed speed at which the feed roller pair or pairs nipping a sheet of paper feed it.

By way of example, in the present invention, as shown with the solid lines in FIG. 4, the feed speed of a sheet of paper is increased to a speed of 1.5V, which is 1.5 times the processing speed of V, at the feed roller pair 61, reduced to a speed of 0.75V at the feed roller pair 62, increased to a speed of 1.25V at the feed roller pair 63, further increased to a speed of 2V at the feed roller pair 64, and slightly reduced to a speed of 1.75V at the feed roller pair 65. With the feed speed further reduced to a speed of 0.25V at the before-registration roller pair 73, the sheet is thrust against the registration roller pair 74. After the sheet is halted and angularly adjusted at the registration roller pair 74, this roller pair feeds the sheet at the processing speed V to the transfer unit 35.

In the present invention, the registration roller pair 74 feeds a sheet of paper at the processing speed V to the transfer unit 35, so that the sheet is fed smoothly without loosening at the transfer position on the transfer unit 35. Likewise, in the conventional feeder, the registration roller pair (74) feeds a sheet of paper at the processing speed V to the transfer unit (35), so that the sheet is fed smoothly without loosening at the transfer position on the transfer unit.

As stated above, in the present invention, when one of the sensors 81-90 at the feed roller pairs 61-70 senses a sheet of paper, the controller 40 finds the time difference between the feed timing when this sensor sensed the sheet and the feed timing when it sensed the preceding sheet. As also stated, according to the found time difference, the controller 40 adjusts the feed speed at which the feed roller pair or pairs nipping the last sensed sheet feed it. This makes the intervals between sheets of paper adequate. The adequate intervals allow time for carrying out angular adjustments at the registration roller pair 74. This makes it possible to feed the sheets in the adequate position and direction to the transfer unit 35 and fixing unit 37. The adequate intervals prevent paper jams, which might occur due to short intervals between the sheets. The adequate intervals also prevent feed speed drops, which would occur due to long intervals between the sheets.

When the sensor 91 at the before-registration roller pair 73 senses the leading end of a sheet of paper, the controller 40 reduces to a preset speed (0.25V in this embodiment) the feed speed at which this roller pair 73 feeds the sheet. This adjusts the feed speed to a suitable speed at which the sheet can be fed while its angular position is corrected at the registration roller pair 74.

The controller 40 changes between 0.5V and 3V the feed speeds at which the feed roller pairs 61-70 feed sheets of paper. The restriction of the feed speeds to 0.5V or higher allows time for carrying out angular adjustments at the registration roller pair 74. This restriction restrains printing rate drops and incomplete image formation, which would occur due to incomplete registration of the leading end of a sheet of paper with the leading end of a toner image. The restriction of the feed speeds to 3V or lower restrains the sheets from forming angles with the feed direction and also restrains the feed roller pairs 61-70 from slipping on the sheets.

If the controller 40 determines that the interval between the time when each of the feed roller pairs 61-70 is feeding a sheet of paper and the time when it fed the preceding sheet is shorter than a preset value, the controller makes the roller pair feed the sheet being nipped by this pair at a speed of 0.5V or higher but lower than 1.0V. This prevents the sheets from overlapping with each other.

If the controller 40 determines that the interval between the time when each of the feed roller pairs 61-70 is feeding a sheet of paper and the time when it fed the preceding sheet is within a preset range, the controller makes the roller pair feed the sheet being nipped by this pair at a speed of 1.0V or higher but lower than 2.0V.

If the controller 40 determines that the interval between the time when each of the feed roller pairs 61-70 is feeding a sheet of paper and the time when it fed the preceding sheet is longer than a preset value, the controller makes the roller pair feed the sheet being nipped by this pair at a speed between 2.0V and 3.0V. This makes this sheet reach the registration roller pair 74 earlier than without the speed control, so that time is allowed for correcting the angular position of the sheet, without the sheet overlapping with the following sheet.

If sheets of paper are fed at speeds higher than 3.0V, they form remarkable angles with the feed direction, so that their edges may rub against the side walls of the feed passages 10-13. This may damage the sheets, so that paper jams are liable to occur. If sheets of paper are fed at speeds higher than 3.0V, they may not be nipped sufficiently by the feed roller pairs 61-70, so that paper jams are liable to occur.

In this embodiment, the feed speeds at which the feed roller pairs 61-70 feed sheets of paper vary between 0.5V and 3V with the shapes and lengths of the feed passages 10-13, the intervals between these roller pairs, the roller diameter, nip width and nip pressure of the pairs, and the type of sheets that the sheet feeder 50 feeds. The feed roller pairs 61-70 feed thinner sheets of paper at lower speeds, and vice versa. The feed roller pairs on the feed passages higher in curvature feed sheets of paper at lower speeds. The feed roller pairs on the linear feed passages feed sheets of paper at higher speeds.

The rotational speeds of the feed roller pairs 61-70 may be adjusted according to voltage. The controller 40 can continuously change the feed speeds at which the feed roller pairs 61-70 and before-registration roller pair 73 feed sheets of paper. This makes it possible to finely adjust the feed speeds.

FIG. 4 shows speed changes along the main feed passages 10 and 11 only, but feed speeds change likewise along the other feed passages 12-14 and 16.

For convenience, descriptions are provided with reference to FIG. 4 as if only one of the feed roller pairs 61-70 nipped and fed a sheet of paper at a time. However, when each of the sensors 81-90 senses the sheet nipped by two or more of the feed roller pairs 61-70 at the same time, it is possible to likewise adjust, according to the time difference between the associated real feed timing and reference feed timing, the feed speed at which the roller pairs nipping the sheet feed it.

Figure 5:
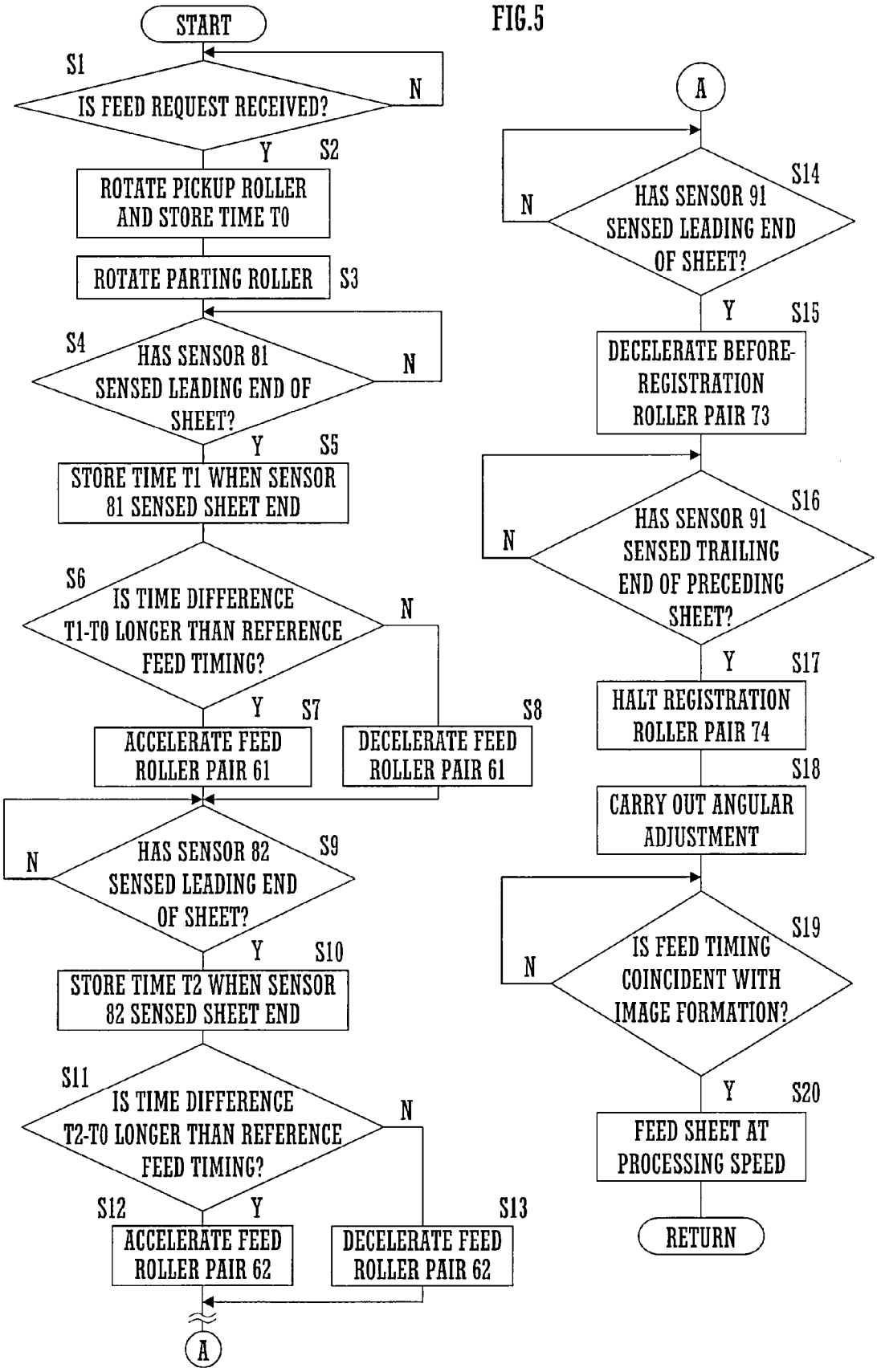
FIG. 5 is a flowchart of part of the procedure performed by the controller of the image forming apparatus.

FIG. 5 shows part of the procedure performed by the controller 40.

If the controller 40 receives a feed request (S1), the controller makes the pickup roller 71 rotate to pick up one or more sheets of paper from the selected feed cassette 401, 402, 403 or 404 at a time T0 and stores the time T0 (S2).

Next, the controller 40 makes the parting roller 72A rotate to feed the picked sheet or sheets to the main feed passage 10 (S3). Even if the pickup roller 71 has picked up two or more sheets, the parting roller 72A feeds the top sheet only.

When the sensor 81 at the feed roller pair 61 senses the leading end of the sheet at a time T1 (S4), the controller 40 stores the time T1 (S5). Next, the controller 40 finds a first real feed timing (T1-T0) by subtracting the time T0 from the time T1 and determines whether the found timing is longer than the associated first reference feed timing (S6), which is stored in the memory 43. If the found timing is longer than the reference feed timing, the controller 40 raises, according to the time difference between the two timings, the feed speed at which the feed roller pair 61 feeds the sheet (S7). For example, the controller 40 raises the feed speed to 1.5V. If the found timing is not longer than the reference feed timing, the controller 40 lowers the feed speed according to the time difference (S8). For example, the controller 40 lowers the feed speed to 0.75V.

When the sensor 82 at the next feed roller pair 62 senses the leading end of the sheet at a time T2 (S9), the controller 40 stores the time T2 (S10). Next, the controller 40 finds a first real feed timing (T2-T0) by subtracting the time T0 from the time T2 and determines whether the found timing is longer than the associated first reference feed timing (S11), which is stored in the memory 43. If the found timing is longer than the reference feed timing, the controller 40 raises, according to the time difference between the two timings, the feed speed at which the feed roller pair 62 feeds the sheet (S12). For example, the controller 40 raises the feed speed to 2V. If the found timing is not longer than the reference feed timing, the controller 40 lowers the feed speed according to the time difference (S13). For example, the controller 40 lowers the feed speed to 0.75V.

For the sensors 83-85 at the next feed roller pairs 63-65, the controller 40 carries out steps similar to S9-S13.

When the sensor 91 at the before-registration roller pair 73 senses the leading end of the sheet (S14), the controller 40 lowers the feed speed at which this roller pair feeds the sheet (S15). For example, the controller 40 lowers the feed speed to 0.25V.

When the sensor 92 at the registration roller pair 74 senses the trailing end of the preceding sheet (S16), the controller 40 halts this roller pair (S17) and carries out an angular adjustment for the sheet being fed by the before-registration roller pair 73 (S18).

At such a timing that the leading end of the sheet being fed by the before-registration roller pair 73 registers with the leading end of a toner image at the transfer position on the transfer unit 35 (S19), the controller 40 restarts the rotation of the registration roller pair 74 to feed this sheet at the processing speed V to the transfer unit 35 (S20).

The controller 40 can, by means of the sensors 81-90 at the feed roller pairs 61-70, find real feed timings, each of which is the interval between the time when one of these sensors senses the leading end of a sheet of paper and the time when this sensor sensed the trailing end of the preceding sheet. The controller 40 can store reference feed timings in advance, each of which is the proper interval between the time when one of the sensors 81-90 senses the trailing end of a sheet of paper and the time when this sensor should sense the leading end of the following sheet. When each of the sensors 81-90 senses the leading end of a sheet of paper, the controller 40 can identify the feed roller pair or pairs nipping the sheet and then change, according to the time difference between the associated real feed timing and reference feed timing, the feed speed at which the nipping roller pair or pairs feed the sheet.

It should be considered that the foregoing description of the embodiment is illustrative in all respects and not restrictive. The scope of the present invention is defined by the appended claims, not by the embodiment, and intended to include meanings equivalent to those of the elements of the claims and all modifications in the claims.

What is claimed is:

1. A sheet feeder comprising:

a feed passage;

a plurality of feed roller pairs arranged along the feed passage for feeding sheets of paper in a feed direction along the passage by nipping the sheets, rotational speeds of the feed roller pairs being adjustable according to a voltage applied thereto;

sensors each fitted at or near one of the feed roller pairs and each adapted to sense a specified point on each of the sheets when the sheet is nipped by at least the associated roller pair; and a controller including a memory for storing reference feed timings as proper feed timings at each of which the specified points on the sheets should pass one of the sensors;

the controller being adapted to find the real feed timing when each of the sensors senses the specified point on the sheet nipped by at least the associated roller pair, wherein, when each of the sensors senses the specified point on the sheet nipped by at least the associated roller pair, the controller finds the time difference between the associated reference feed timing and the associated real feed timing and controls, according to the found time difference, the feed speed at which the feed roller pair or pairs nipping the sheet feed the sheet by adjusting the rotational speeds of the feed roller pairs, the sheet feeder further comprising a registration roller disposed near and upstream of a processing unit in the feed direction, wherein the feed passage extends from a feed unit for storing sheets of paper to be fed, to the processing unit, the feeder feeds the sheets from a preset reference position to the feed roller pairs;

the reference feed timing for each of the sensors being the time that should be taken to feed each of the sheets from the reference position to the respective sensor;

the real feed timing for each of the sensors being the time taken to feed each of the sheets from the reference position to the respective sensor, the registration roller is adapted to feed sheets of paper at the same speed as a processing speed at which the processing unit provides processing for the sheets, and the controller individually adjusts, according to the time difference found at a location of each of the sensors, a rotational speed of each of the feed roller pairs.

2. A sheet feeder as claimed in claim 1, wherein the feed passage is extended from downstream side of the processing unit to upstream side thereof in the feed direction through the registration roller.

3. A sheet feeder as claimed in claim 1, wherein the controller controls the feed speed between 0.5 times the processing speed and 3 times the processing speed.

4. A sheet feeder as claimed in claim 1, wherein the controller reduces the feed speed at which each of the sheets is fed near the side of the registration roller that is upstream in the feed direction.

5. A sheet feeder as claimed in claim 1, wherein the reference feed timings are such that the leading end of each of the sheets is not positioned over or under the trailing end of the preceding sheet at the registration roller.

6. A sheet feeder as claimed in claim 1, wherein the controller continuously controls the feed speed.

* * * * *